US008910935B2

(12) United States Patent
Totani

(10) Patent No.: US 8,910,935 B2
(45) Date of Patent: Dec. 16, 2014

(54) SHEET PRODUCTS STACKING AND FEEDING APPARATUS

(71) Applicant: Totani Corporation, Kyoto (JP)

(72) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 0 days.

(21) Appl. No.: 14/159,556

(22) Filed: Jan. 21, 2014

(65) Prior Publication Data

US 2014/0203502 A1 Jul. 24, 2014

(30) Foreign Application Priority Data

Jan. 24, 2013 (JP) ..... 2013-011321

(51) Int. Cl.
*B65H 31/32* (2006.01)

(52) U.S. Cl.
CPC ..... *B65H 31/32* (2013.01); *B65H 2405/323* (2013.01); *B65H 2404/2571* (2013.01); *B65H 2301/42256* (2013.01); *B65H 2404/6911* (2013.01); *B65H 2301/42622* (2013.01); *B65H 2701/191* (2013.01)
USPC ..... 271/218; 271/189; 414/790.8

(58) Field of Classification Search
CPC ..... B65H 31/32; B65H 2301/42622; B65H 2301/42256
USPC ..... 271/218, 189, 190; 414/790.8
See application file for complete search history.

(56) References Cited

U.S. PATENT DOCUMENTS

| | | | | |
|---|---|---|---|---|
| 3,140,091 | A * | 7/1964 | Reif et al. | 271/218 |
| 3,362,707 | A * | 1/1968 | Lauren | 271/218 |
| 3,374,902 | A * | 3/1968 | Mills | 414/789.1 |
| 4,934,687 | A * | 6/1990 | Hayden et al. | 271/202 |
| 5,116,041 | A * | 5/1992 | Pollich | 271/158 |
| 5,131,647 | A * | 7/1992 | Henn et al. | 271/189 |
| 5,493,104 | A | 2/1996 | Wilson | |
| 5,664,767 | A * | 9/1997 | Voss | 271/218 |
| 6,042,108 | A * | 3/2000 | Morgan et al. | 271/201 |
| 6,234,473 | B1 * | 5/2001 | Morgan et al. | 271/201 |
| 6,978,996 | B2 * | 12/2005 | Strauss et al. | 271/213 |
| 7,354,039 | B2 * | 4/2008 | Bantlin et al. | 271/218 |
| 7,364,398 | B2 * | 4/2008 | Michler et al. | 414/789.9 |
| 7,401,775 | B2 * | 7/2008 | Hirth et al. | 271/218 |
| 8,356,967 | B2 * | 1/2013 | Gammerler | 414/790.8 |
| 2011/0206490 | A1 * | 8/2011 | Maier | 414/792.7 |

FOREIGN PATENT DOCUMENTS

| | | |
|---|---|---|
| DE | 1561445 | 4/1970 |
| EP | 1340705 | 9/2003 |
| EP | 1400473 | 3/2004 |
| JP | S5548148 | 4/1980 |
| JP | 2004-189455 | 7/2004 |
| JP | 2012-206458 | 10/2012 |

* cited by examiner

*Primary Examiner* — Patrick Cicchino
(74) *Attorney, Agent, or Firm* — Kirschstein et al.

(57) ABSTRACT

In an apparatus for stacking and feeding sheet products discharged successively from a discharge position, catcher bars 4 are bent to be accumulated at an accumulated position. The sheet products collide against shutter bars 9 to fall onto a conveyor 3 after being discharged successively, for stacking the sheet products on the conveyor 3. The catcher bars 4 are pushed out of the accumulated position to pass between the shutter bars 9 and protrude toward the discharge position so that coming products should be received on the catcher bars 4 after stacking the sheet products.

11 Claims, 3 Drawing Sheets

SHEET PRODUCTS STACKING AND FEEDING APPARATUS

TECHNICAL FIELD

The invention relates to an apparatus for stacking and feeding sheet products discharged successively from a discharge position.

BACKGROUND

For example, Japanese Patent Publication No. 4,902,796 discloses a machine for successively making plastic bags. The machine includes a longitudinal heater, a cross heater and a cutter by which plastic films are heat sealed with each other longitudinally and widthwise thereof and cross cut widthwise, to successively make plastic bags. The plastic bags are then discharged successively and horizontally. In this case, it is required to stack the plastic bags to achieve a quorum and feed the plastic bags whenever stacking them.

Japanese Laid-Open Patent publication No. 189,455-2004 discloses an apparatus to fulfill the requirement. In the apparatus of the publication, the plastic bags are discharged successively by nip rollers after making the plastic bags. A shutter plate is disposed above a conveyor so that the plastic bags should collide against the shutter plate to fall onto the conveyor after being discharged successively, for stacking the plastic bags on the conveyor. The apparatus is arranged to feed the plastic bags by the conveyor after stacking the plastic bags to achieve a quorum.

However, the apparatus is problematic in that until feeding the plastic bags after stacking, coming bags are not allowable to fall onto the conveyor for stacking. The machine has therefore to be stopped temporarily so that the coming bags will not be discharged temporarily. The plastic bags cannot be discharged continuously. The machine can therefore not continuously make plastic bags.

In order to overcome the problem, catcher bars should be disposed above the conveyor and opposed to the discharge position. The catcher bars extend in the discharge direction of plastic bags. The catcher bars are arranged and spaced from each other in a lateral direction. It should be understood that the lateral direction denotes a horizontal direction normal to the discharge direction. In addition, shutter bars should be substituted for the shutter plate and disposed between the discharge position and the catcher bars. The shutter bars extend vertically. The shutter bars are also arranged and spaced from each other in the lateral direction. The plastic bags can therefore collide against the shutter bars to fall onto the conveyor after being discharged successively, for stacking the plastic bags on the conveyor. In addition, the catcher bars are moved longitudinally thereof to pass between the shutter bars and protrude toward the discharge position so that coming bags should be received on the catcher bars after stacking the plastic bags. The catcher bars are then moved reversely to be returned to the original position so that the coming bags should fall onto the conveyor after feeding the plastic bag by the conveyor. Subsequently, the plastic bags collide against the shutter bars to fall onto the conveyor for stacking. The plastic bags can therefore be discharged continuously. The machine can continuously make the plastic bags.

In this case, in the discharge direction of plastic bags, the catcher bars must protrude downstream thereof when being returned to the original position. In addition, the catcher bars have to be held and moved by a catcher drive at the downstream end thereof, taking a large space. The catcher bars must be heavy, taking a large energy when being moved. In a machine for making the plastic bags at high speed, the catcher bars have to be moved and returned at high speed to protrude downstream thereof at high speed, resulting in a problem of safety of operator.

The apparatus may be applied to sheet products other than the plastic bags to stack and feed them discharged successively from a discharge position. However, the fact remains that the apparatus has the problems of large space, large energy and safety.

It is therefore an object of the invention to provide an apparatus for stacking and feeding sheet products discharged successively from a discharge position, in which the sheet products can be discharged continuously without involving the problems of large space, large energy and safety.

SUMMARY OF THE INVENTION

According to the invention, the apparatus comprises catcher bars formed of flexible metal belts. The catcher bars are disposed above a conveyor, opposed to the discharge position, bent to be accumulated at an accumulated position and arranged and spaced from each other in a lateral direction. The accumulated position is spaced from the discharge position. The apparatus further comprises shutter bars disposed between the discharge position and the catcher bars. The shutter bars extend vertically. The shutter bars are also arranged and spaced from each other in the lateral direction so that the sheet products should collide against the shutter bars to fall onto the conveyor after being discharged successively, for stacking the sheet products on the conveyor. The apparatus further comprises a catcher drive by which the catcher bars are pushed out of the accumulated position to pass between the shutter bars and protrude toward the discharge position so that coming products should be received on the catcher bars after stacking the sheet products. The catcher bars are then bent by the catcher drive to be returned to and accumulated at the accumulated position so that the coming products should fall onto the conveyor after feeding the sheet products by the conveyor.

In a preferred embodiment, the catcher bars are taken up into rolls to be bent spirally for accumulation. The rolls are rotated by the catcher drive so that the catcher bars should be pushed out.

The catcher bars may be engaged with a catcher guide to be bent upwardly for accumulation. The catcher bars terminate at end portions connected to the catcher drive so that the catcher bars should be pushed downwardly by the catcher drive and guided by the catcher guide to be pushed out.

The catcher bars are trough-shaped in cross section.

The catcher bars are pushed out by the catcher drive for protrusion before stacking the sheet products to achieve a quorum. The sheet products are discharged successively to fall onto the conveyor for stacking below the catcher bars. The apparatus further comprises an additional drive by which the catcher bars are lowered so that the coming products should be received on the catcher bars after stacking the sheet products to achieve the quorum.

The catcher bars may be pushed out by the catcher drive for protrusion after stacking the sheet products to achieve a quorum. The coming products are then received on the catcher bars.

The apparatus further comprises a shutter drive by which the shutter bars are lifted after stacking the sheet products to achieve a quorum, to feed the sheet products by the conveyor below the shutter bars.

BEST MODE TO CARRY OUT THE INVENTION

Figure 1:
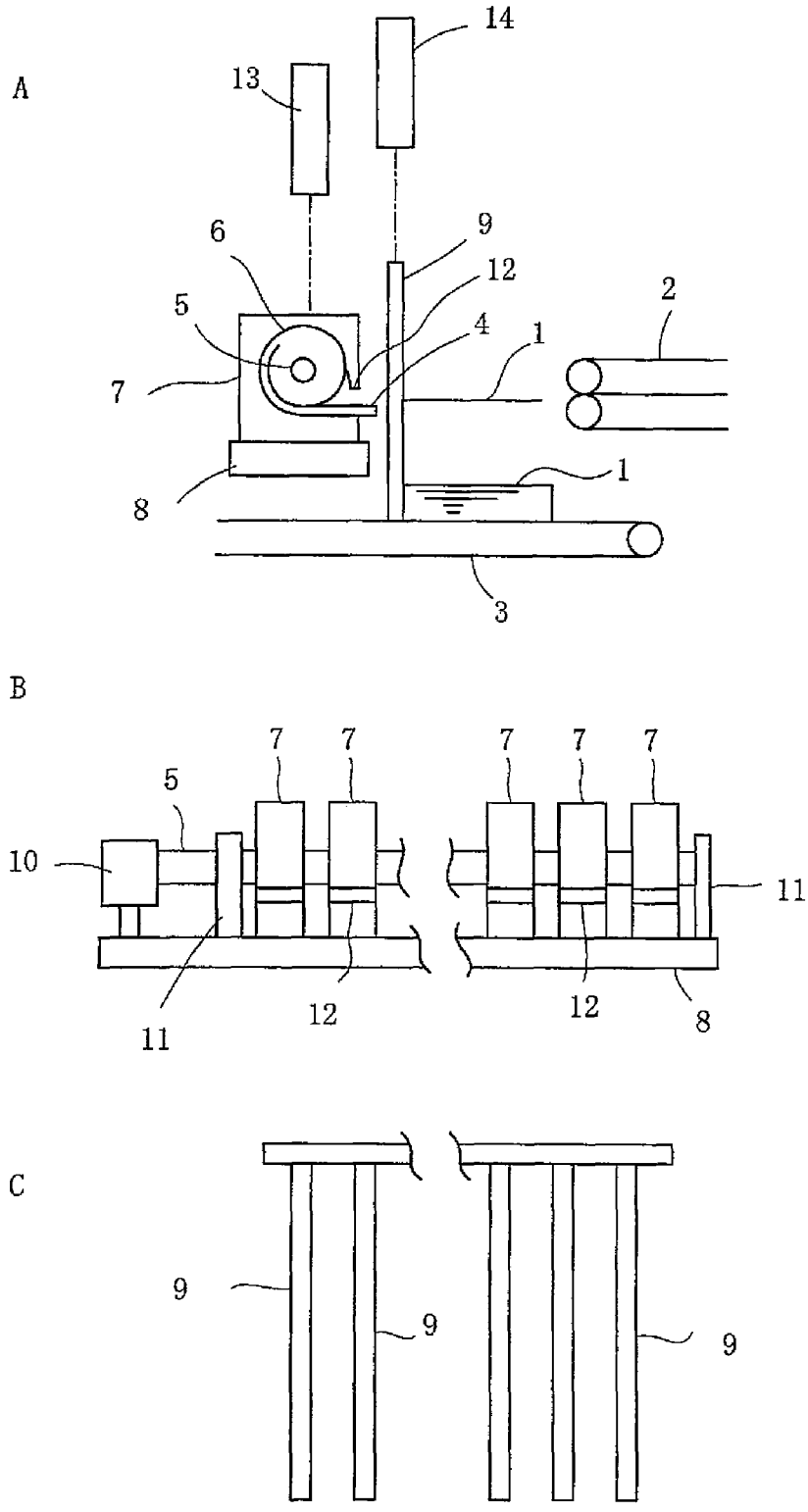
FIG. 1 is a side view (A) of a preferred embodiment of the invention, an elevational view (B) of the cases of (A) and an elevational view (C) of the shutter bars of (A).

Turning now to the drawings, FIG. 1 illustrates an apparatus for stacking and feeding sheet products discharged successively from a discharge position, according to the invention. The apparatus is incorporated into a machine for successively making plastic bags. The machine has the same structure as that of Japanese Patent Publication No. 4,902,796 and includes a longitudinal heater, a cross heater and a cutter by which plastic films are heat sealed with each other longitudinally and widthwise thereof and cross cut widthwise, to successively make plastic bags 1. The plastic bags 1 are then discharged successively by stacker belts 2. It should therefore be understood that sheet products are discharged successively and horizontally. The sheet products comprise the plastic bags 1. The apparatus is used to stack and feed the plastic bags 1.

The apparatus includes a conveyor 3 and catcher bars 4. The catcher bars 4 are formed of flexible metal belts. For example, the catcher bars 4 are formed of flexible steel belts. The catcher bars 4 are disposed above the conveyor 3, opposed to the discharge position, bent to be accumulated at an accumulated position and arranged and spaced from each other in a lateral direction. The accumulated position is spaced from the discharge position of plastic bags 1. In this connection, it should be understood that the stacker belts 2 includes end portions disposed at the discharge position from which the plastic bags 1 are discharged successively. The lateral direction denotes a horizontal direction normal to the discharge direction of plastic bags 1.

In the embodiment, the catcher bars 4 are taken up into rolls 6 about a shaft 5 to be bent spirally for accumulation. The rolls 6 are arranged and spaced from each other in the lateral direction and received in cases 7. They are disposed at the accumulated position spaced from the discharge position. The cases 7 are fixed to a base 8 disposed above the conveyor 3. The conveyor 3 extends in the discharge direction of plastic bags 1.

The apparatus further includes shutter bars 9 disposed between the discharge position and the catcher bars 4. The shutter bars 9 extend vertically. The shutter bars 9 are also arranged and spaced from each other in the lateral direction so that the plastic bags 1 should collide against the shutter bars 9 to fall along the shutter bars 9 and onto the conveyor 3 after being discharged successively, for stacking the plastic bags 1 on the conveyor 3. The shutter bars 9 are disposed at intervening positions corresponding to clearances between the catcher bars 4 which are spaced from each other in the lateral direction.

The apparatus further includes a catcher drive by which the catcher bars 4 are pushed out of the accumulated position to pass between the shutter bars 9 and protrude toward the discharge position so that coming bags 1 should be received on the catcher bars 4 after stacking the plastic bags 1. The conveyor 3 is then driven by a conveyor drive to feed the plastic bags 1 for a distance corresponding to or larger than the size of plastic bag 1. The catcher bars 4 are bent by the catcher drive to be returned to and accumulated at the accumulated position so that the coming bag 1 should fall along the shutter bars 9 and onto the conveyor 3 after feeding the plastic bags 1 by the conveyor 3.

In the embodiment, the catcher drive comprises a drive motor 10 connected to the shaft 5 which passes through the cases 7 to be supported by brackets 11. The drive motor 10 and the brackets 11 are fixed to and supported by the base 8. The cases 7 include slots 12 formed therein. The rolls 6 are rotated by the drive motor 10 integrally with the shaft 5 so that the catcher bars 4 should be pushed out for protrusion. The catcher bars 4 are pushed out for protrusion from the slots 12 of cases 7. The coming bags 1 therefore collide against the shutter bars 9 to be received on the catcher bars 4 after stacking the plastic bags 1.

Figure 2:
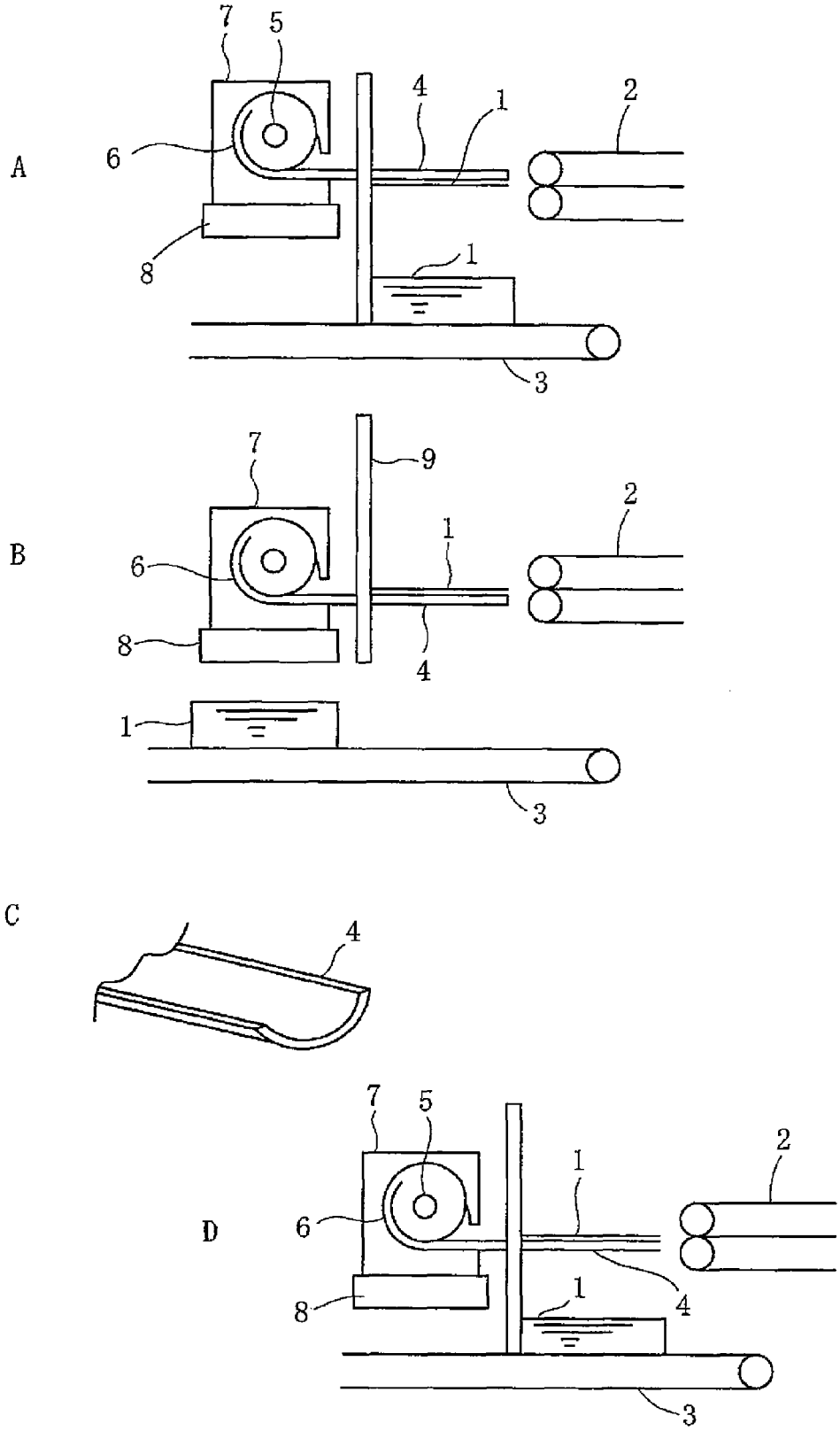
FIG. 2 is a side view (A) of the catcher bars of FIG. 1 when protruding, a side view (B) of the catcher bars of (A) when being lowered, a perspective view (C) of the catcher bars of (B) and a side view (D) of another embodiment.

In addition, the apparatus further includes an additional drive comprising a cylinder 13 connected to the base 8 so that the catcher bars 4, the cases 7 and the base 8 should be lifted by the cylinder 13. Subsequently, the catcher bars 4 are pushed out by the drive motor 10 for protrusion before stacking the plastic bags 1 to achieve a quorum, as shown in FIG. 2. The plastic bags 1 are discharged successively to fall onto the conveyor 3 for stacking below the catcher bars 4 (FIG. 2A). The catcher bars 4 are then lowered by the cylinder 13 to be returned to the original position in height after stacking the plastic bags 1 to achieve the quorum. The coming bags 1 therefore collide against the shutter bars 9 to be received on the catcher bars 4.

The apparatus further includes a shutter bar drive comprising a cylinder 14 connected to the shutter bars 9. The coming bags 1 are received on the catcher bars 4 after stacking the plastic bags 1 to achieve the quorum, as described previously. At the same time, the shutter bars 9 are lifted by the cylinder 14 to feed the plastic bags 1 by the conveyor 3 below the shutter bars 9 (FIG. 2B). The shutter bars 9 are lowered by the cylinder 14 after feeding the plastic bags 1. The rolls 6 are then rotated by the drive motor 10 so that the catcher bars 4 should be taken up into the rolls 6 to be bent spirally. The catcher bars 4 are therefore returned to and accumulated at the accumulated position so that the coming bags 1 should fall along the shutter bars 9 and onto the conveyor 3 for stacking. In addition, the catcher bars 4 are lifted by the cylinder 13 after being returned and accumulated.

The catcher bars 4 are flexible, but trough-shaped in cross section (FIG. 2C). The catcher bars 4 therefore have a stiffness to protrude adequately when the rolls 6 are rotated by the drive motor 10. The stiffness is effective in stabilizing the coming bags 1 received on the catcher bars 4.

The plastic bags 1 collide against the shutter bars 9 to fall onto the conveyor 3 again after the catcher bars 4 are returned and the plastic bags 1 are discharged, for stacking the plastic bags 1. The catcher bars 4 then protrude toward the discharge position of plastic bags 1 so that coming bags 1 should be received on the catcher bars 4, the steps being performed repeatedly. The apparatus can therefore stack the plastic bags 1 to achieve the quorum and feed the plastic bags 1 whenever stacking.

In the apparatus, the plastic bags 1 can be discharged continuously by reason that coming bags 1 are received on the catcher bars 8 after stacking the plastic bags 1. Unlike the prior art, the coming bags 1 can be discharged irrespective of feeding the plastic bags 1. The machine can therefore continuously make the plastic bags 1. The machine has not to be stopped temporarily.

In addition, the catcher bars 4 are then bent by the catcher drive to be returned to and accumulated at the accumulated position so that the coming bag 1 should fall onto the conveyor 3. The catcher bars 4 do not protrude downstream thereof in the discharge direction of plastic bags 1, not taking a large space. The catcher bars 4 are actuated for protrusion and return by using the rolls 6 merely rotated, not taking a large energy. The catcher bars 4 do not protrude downstream thereof, not resulting in the problem of safety of operator.

The catcher bars 4 have not always to be pushed out by the drive motor 10 for protrusion before stacking the plastic bags 1. The catcher bars 4 may be pushed out by the drive motor 10 for protrusion after stacking the plastic bags 1 to achieve a quorum, the coming bags 1 being then received on the catcher bars 4 (FIG. 2D). The catcher bars 4 are then returned by the drive motor 10 so that the coming bags 1 should fall onto the conveyor 3 after feeding the plastic bags 1 by the conveyor 3. In this case, the catcher bars 4 have not to be lifted nor lowered by the cylinder 13 of FIG. 1.

Figure 3:
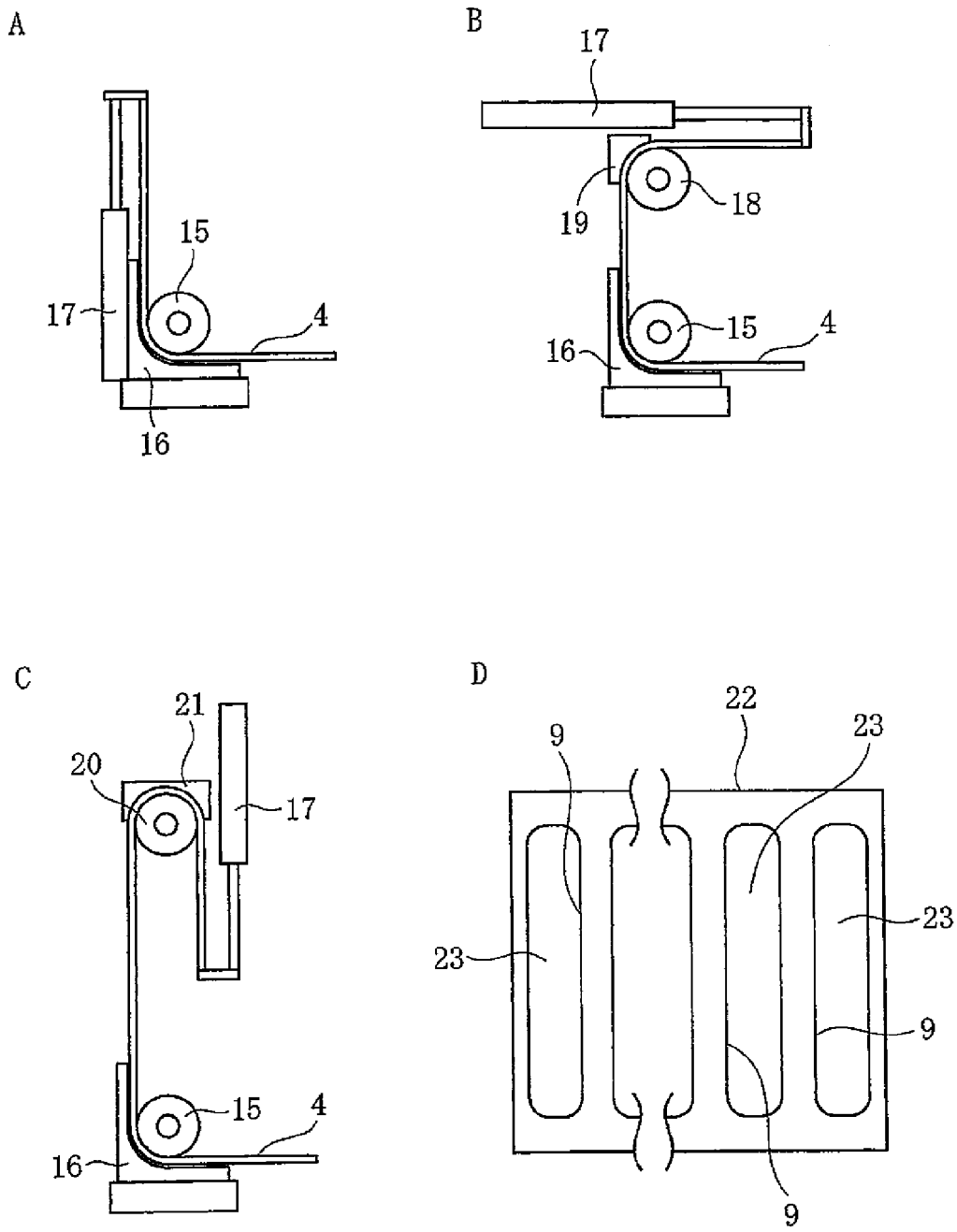
FIG. 3 is a side view (A) of another embodiment, a side view (B) of another embodiment, a side view (C) of another embodiment and an elevational view (D) of another embodiment.

The catcher bars 4 may be engaged with a catcher guide to be bent upwardly for accumulation, as shown in FIG. 3. The catcher bars 4 terminate at end portions connected to the catcher drive so that the catcher bars 4 should be pushed downwardly by the catcher drive and guided by the catcher guide to be pushed out. The catcher guide comprises a roller 15 and a member 16 with which the catcher bars 4 are engaged. The catcher bars 4 are therefore pushed downwardly by the catcher drive and guided by the roller 15 and the member 16 to be pushed out.

For example, the catcher drive comprises a cylinder 17 disposed vertically. The catcher bars 4 are bent upwardly to terminate at end portions connected to the cylinder 17 (FIG. 3A). The catcher bars 4 have the same structure as those of FIG. 2 to be trough-shaped in cross section. In this case, the catcher bars 4 are pushed downwardly by the cylinder 17 and guided by the roller 15 and the member 16 to be pushed out. The catcher bars 4 therefore pass between the shutter bars 9 and protrude toward the discharge position of plastic bags 1 so that coming bags 1 should be received on the catcher bars 4. The catcher bars 4 are then bent by the cylinder 17 to be returned to and accumulated at the accumulated position so that the coming bags 1 should fall onto the conveyor 3.

The cylinder 17 may be disposed horizontally. The catcher guide includes a roller 18 and a member 19 with which the catcher bars 4 are engaged to terminate at end portions connected to the cylinder 17 (FIG. 3B). The catcher bars 4 have the same structure as those of FIG. 2. In this case, the catcher bars 4 are pushed downwardly by the cylinder 17, the roller 18 and the member 19 to be pushed out. The cylinder 17 may be disposed vertically and reversely. The catcher guide includes a roller 20 and a member 21 with which the catcher bars 4 are engaged to terminate at end portions connected to the cylinder 17 (FIG. 3C). In this case, the catcher bars 4 are pushed downwardly by the cylinder 17, the roller 20 and the member 21 to be pushed out.

The shutter bars 9 may be formed by a shutter plate 22 including openings 23 formed between the shutter bars 9 (FIG. 3D).

The apparatus may be applied to sheet products other than the plastic bags 1 to stack and feed them discharged successively from a discharge position.

What is claimed is:

1. An apparatus for stacking and feeding sheet products discharged successively from a discharge position, comprising:

catcher bars formed of flexible metal belts, disposed above a conveyor, opposed to the discharge position, bent to be accumulated at an accumulated position, and arranged and spaced from each other in a lateral direction, the accumulated position being spaced from the discharge position;

shutter bars disposed between the discharge position and the catcher bars, extending vertically, and arranged and spaced from each other in the lateral direction so that the sheet products collide against the shutter bars to fall onto the conveyor after being discharged successively, for stacking the sheet products on the conveyor; and a catcher drive by which the catcher bars are pushed out of the accumulated position to pass between the shutter bars and protrude toward the discharge position so that coming products are received on the catcher bars after stacking the sheet products, the catcher bars being then bent by the catcher drive to be returned to, and accumulated at, the accumulated position so that the coming products fall onto the conveyor after feeding the sheet products by the conveyor, wherein the catcher bars are engaged with a catcher guide to be bent upwardly for accumulation, the catcher bars terminating at end portions connected to the catcher drive so that the catcher bars are pushed downwardly by the catcher drive and guided by the catcher guide to be pushed out.

2. The apparatus as set forth in claim 1, wherein the catcher bars are trough-shaped in cross section.

3. The apparatus as set forth in claim 1, wherein the catcher bars are pushed out by the catcher drive for protrusion before stacking the sheet products to achieve a quorum, the sheet products being discharged successively to fall onto the conveyor for stacking below the catcher bars, the apparatus further comprising an additional drive by which the catcher bars are lowered so that the coming products are received on the catcher bars after stacking the sheet products to achieve the quorum.

4. The apparatus as set forth in claim 1, wherein the catcher bars are pushed out by the catcher drive for protrusion after stacking the sheet products to achieve a quorum, the coming products being then received on the catcher bars.

5. The apparatus as set forth in claim 1, further comprising a shutter drive by which the shutter bars are lifted after stacking the sheet products to achieve a quorum, to feed the sheet products by the conveyor below the shutter bars.

6. An apparatus for stacking and feeding sheet products discharged successively from a discharge position, comprising:

catcher bars formed of flexible metal belts, disposed above a conveyor, opposed to the discharge position, bent to be accumulated at an accumulated position, and arranged and spaced from each other in a lateral direction, the accumulated position being spaced from the discharge position;

shutter bars disposed between the discharge position and the catcher bars, extending vertically, and arranged and spaced from each other in the lateral direction so that the sheet products collide against the shutter bars to fall onto the conveyor after being discharged successively, for stacking the sheet products on the conveyor;

a catcher drive by which the catcher bars are pushed out of the accumulated position to pass between the shutter bars and protrude toward the discharge position so that coming products are received on the catcher bars after stacking the sheet products, the catcher bars being then bent by the catcher drive to be returned to, and accumulated at, the accumulated position so that the coming products fall onto the conveyor after feeding the sheet products by the conveyor; and a shutter drive by which the shutter bars are lifted after stacking the sheet products to achieve a quorum, to feed the sheet products by the conveyor below the shutter bars.

7. The apparatus as set forth in claim 6, wherein the catcher bars are taken up into rolls to be bent spirally for accumulation, the rolls being rotated by the catcher drive so that the catcher bars are pushed out.

8. The apparatus as set forth in claim 6, wherein the catcher bars are trough-shaped in cross section.

9. The apparatus as set forth in claim 6, wherein the catcher bars are pushed out by the catcher drive for protrusion before stacking the sheet products to achieve the quorum, the sheet products being discharged successively to fall onto the conveyor for stacking below the catcher bars, the apparatus further comprising an additional drive by which the catcher bars are lowered so that the coming products are received on the catcher bars after stacking the sheet products to achieve the quorum.

10. The apparatus as set forth in claim 6, wherein the catcher bars are pushed out by the catcher drive for protrusion after stacking the sheet products to achieve the quorum, the coming products being then received on the catcher bars.

11. The apparatus as set forth in claim 6, wherein the catcher bars are engaged with a catcher guide to be bent upwardly for accumulation, the catcher bars terminating at end portions connected to the catcher drive so that the catcher bars are pushed downwardly by the catcher drive and guided by the catcher guide to be pushed out.

* * * * *